US005969696A

United States Patent [19]

Stoye

[11] Patent Number: 5,969,696

[45] **Date of Patent: *Oct. 19, 1999**

[54] STANDARD INTERFACE SYSTEM BETWEEN DIFFERENT LCD PANELS AND A COMMON FRAME BUFFER OUTPUT

[75] Inventor: Donald Stoye, Santa Clara, Calif.

[73] Assignee: Sun Microsystems, Inc., Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/558,923

[22] Filed: Nov. 13, 1995

Related U.S. Application Data

[63] Continuation of application No. 08/384,344, Feb. 1, 1995, abandoned, which is a continuation of application No. 08/191,983, Feb. 4, 1994, abandoned.

[51] Int. Cl.[6] ..... G09G 5/00

[52] U.S. Cl. ..... 345/1; 345/87; 345/903

[58] Field of Search ..... 345/1, 2, 3, 60, 345/87, 204, 211, 901, 903, 905; 364/708.1, 709.09, 709.1

[56] References Cited

U.S. PATENT DOCUMENTS

| | | | |
|---|---|---|---|
| 4,978,949 | 12/1990 | Herron et al. | 345/168 |
| 4,980,678 | 12/1990 | Zenda | 345/3 |
| 5,111,190 | 5/1992 | Zenda | 345/60 |
| 5,159,683 | 10/1992 | Lvovsky | 364/927.2 |
| 5,300,944 | 4/1994 | Shapiro et al. | 345/88 |
| 5,670,969 | 9/1997 | Yamagami et al. | 345/1 |

FOREIGN PATENT DOCUMENTS

| | | | |
|---|---|---|---|
| 0510814 | 3/1993 | European Pat. Off. . | |
| 0531893 | 9/1993 | European Pat. Off. . | |
| 9317220 U | 2/1994 | Germany . | |
| 3-136094 | 6/1991 | Japan | 345/3 |
| 3-226792 | 10/1991 | Japan | 345/3 |
| 5-173524 | 7/1993 | Japan | 345/3 |

OTHER PUBLICATIONS

Elektor Electronics, vol. 19, No. 214, Sep. 1993; pp. 8–12.

Mein, J. "Color TV Display: Use Those New LSI Chips" Microcomputing Feb. 1980. pp. 148–156.

"Monitor Identification Range Extension", IBM Tech Disc Bull 33(6A):351 Nov. 1990.

*Primary Examiner*—Xiao Wu

*Attorney, Agent, or Firm*—Blakely Sokoloff Taylor & Zafman

[57] ABSTRACT

The present invention provides an interface for a computer system that can drive several different display systems. The interface of the present invention consists of power signals, ground signals, sense signals, programmable signals, and a few miscellaneous signals. The sense signals are driven by each display system that is designed to operate with the interface of the present invention. Each display system drives the sense signals with a code that uniquely identifies the display system. The interface is self-configuring such that the computer system reads the unique code output on the sense signals and correspondingly outputs the proper display information on the programmable signals to drive the display system connected to the interface.

6 Claims, 4 Drawing Sheets

| 68 Pin Conn | Mono Signal Name | Color Signal Name A | Color Signal Name B |
|---|---|---|---|
| 1 | GND | GND | GND |
| 2 | Tx | Tx | Tx |
| 3 | | | |
| 4 | BattRet | BattRet | BattRet |
| 5 | Hsync | Hsync | Hsync |
| 6 | BattRet | BattRet | BattRet |
| 7 | BLenb | BLenb | BLenb |
| 8 | +Batt | +Batt | +Batt |
| 9 | GND | GND | GND |
| 10 | SD2 | SD2 | SD2 |
| 11 | GND | GND | GND |
| 12 | +5V | +5V | +5V |
| 13 | GND | GND | GND |
| 14 | +12V | +12V | +12V |
| 15 | | | |
| 16 | | | |
| 17 | | B12 | B13 |
| 18 | | B10 | B11 |
| 19 | GND | GND | GND |
| 20 | | B01 | B02 |
| 21 | | N/C | B00 |
| 22 | D17 | G12 | G13 |
| 23 | D15 | G10 | G11 |
| 24 | GND | GND | GND |
| 25 | D12 | G01 | G02 |
| 26 | D10 | N/C | G00 |
| 27 | D07 | R12 | R13 |
| 28 | D05 | R10 | R11 |
| 29 | GND | GND | GND |
| 30 | D02 | R01 | R02 |
| 31 | D00 | N/C | R00 |
| 32 | HS | HS | HS |
| 33 | VS | VS | VS |
| 34 | CLK | CLK | CLK |

*Figure 3a*

| 68 Pin Conn | Mono Signal Name | Color Signal Name A | Color Signal Name B |
|---|---|---|---|
| 35 | Rx | Rx | Rx |
| 36 | +5V | +5V | +5V |
| 37 | | | |
| 38 | Brit | Brit | Brit |
| 39 | BattRet | BattRet | BattRet |
| 40 | BattRet | BattRet | BattRet |
| 41 | +Batt | +Batt | +Batt |
| 42 | +Batt | +Batt | +Batt |
| 43 | SD3 | SD3 | SD3 |
| 44 | SD1 | SD1 | SD1 |
| 45 | GND | GND | GND |
| 46 | +5V | +5V | +5V |
| 47 | GND | GND | GND |
| 48 | +12V | +12V | +12V |
| 49 | | | |
| 50 | GND | GND | GND |
| 51 | | B11 | B12 |
| 52 | | N/C | B10 |
| 53 | | B02 | B03 |
| 54 | | B00 | B01 |
| 55 | GND | GND | GND |
| 56 | D16 | G11 | G12 |
| 57 | D14 | N/C | G10 |
| 58 | D13 | G02 | G03 |
| 59 | D11 | G00 | G01 |
| 60 | GND | GND | GND |
| 61 | D06 | R11 | R12 |
| 62 | D04 | N/C | R10 |
| 63 | D03 | R02 | R03 |
| 64 | D01 | R00 | R01 |
| 65 | GND | GND | GND |
| 66 | GND | GND | GND |
| 67 | GND | GND | GND |
| 68 | GND | GND | GND |

*Figure 3b*

STANDARD INTERFACE SYSTEM BETWEEN DIFFERENT LCD PANELS AND A COMMON FRAME BUFFER OUTPUT

This is a continuation of application Ser. No. 08/384,344 filed Feb. 1, 1995, now abandoned which is a continuation of Ser. No. 08/191,983 filed Feb. 4, 1994 now abandoned.

FIELD OF THE INVENTION

The present invention relates to the field of portable electronic devices. Specifically, the present invention relates to a portable electronic device having and interface for connecting several different types of display devices.

BACKGROUND OF THE INVENTION

To enhance the flexibility of a computer system, it is desirable to design a computer system such that additional peripherals can easily be added. However, portable computer systems are often difficult to expand since their small size precludes the use of many common expansion buses. Therefore, it is desirable to create expandable external ports on portable computer systems.

Most computer systems include a display unit for displaying information to a user. In prior art portable computer systems, the display unit is usually an integrated part of the computer system. However, to provide additional flexibility, it would be desirable to provide an external port capable of driving several different types of displays.

SUMMARY OF THE INVENTION

The present invention provides an interface for a computer system that can drive several different display systems. The interface of the present invention consists of power signals, ground signals, sense signals, programmable signals, and a few miscellaneous signals. The sense signals are driven by each display system that is designed to operate with the interface of the present invention. Each display system drives the sense signals with a code that uniquely identifies the display system. The interface is self-configuring such that the computer system reads the unique code output on the sense signals and correspondingly outputs the proper display information on the programmable signals to drive the display system connected to the interface.

BRIEF DESCRIPTION OF THE DRAWINGS

The objects, features, and advantages of the present invention will be apparent from the following detailed description of the preferred embodiment of the invention with references to the following drawings.

FIG. 3*a* provides a list of signals 1–34 of a 68 signal monitor connection for three different types of display systems.

FIG. 3*b* provides a list of signals 35–68 of a 68 signal monitor connection for three different types of display systems.

DETAILED DESCRIPTION

Methods and apparatus for providing an external display port that can drive several types of displays are disclosed. In the following description, for purposes of explanation, specific nomenclature is set forth to provide a thorough understanding of the present invention. However, it will be apparent to one skilled in the art that these specific details are not required to practice the present invention.

Figure 1:
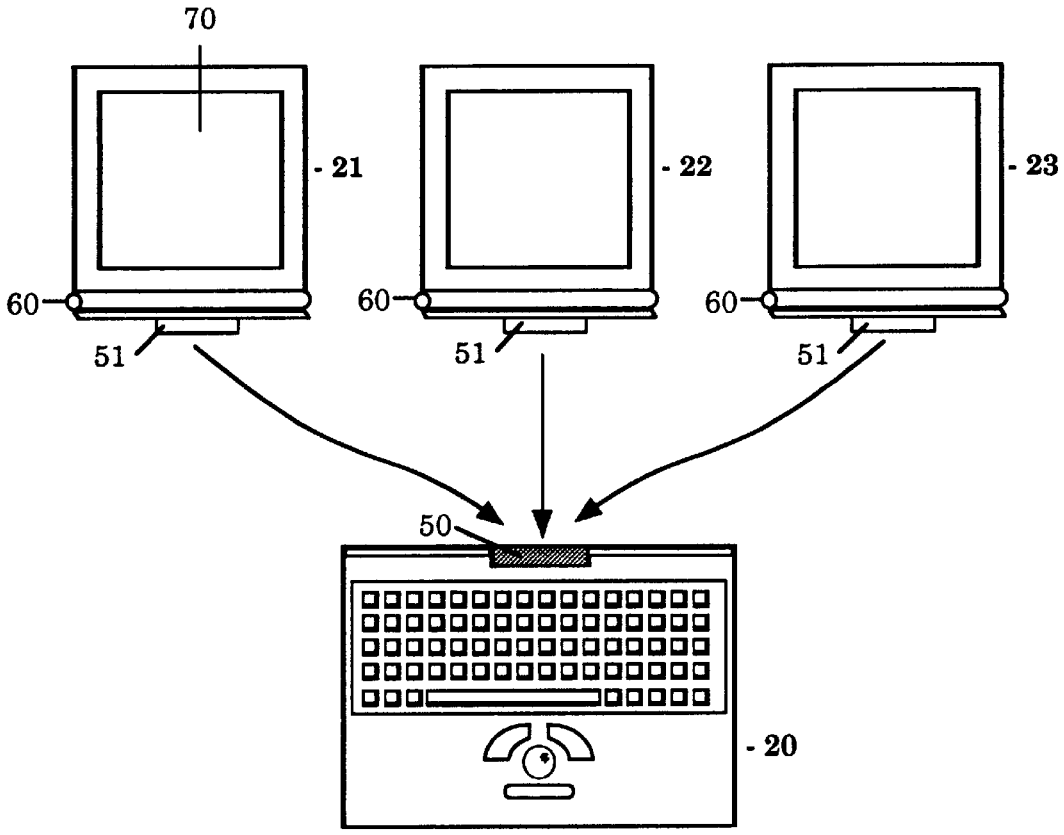
FIG. 1 illustrates a computer system with an self-configuring interface for a monitor that drives several different types of monitors.

FIG. 1 illustrates a portable computer system 20. To provide the ability of driving several different types of displays, the portable computer system 20 is constructed with a self-configuring monitor interface 50. As illustrated in FIG. 1, several different types of display systems (21, 22, and 23) can be connected to the same self-configuring monitor interface 50. Each type of display system has an interface board 51 that couples to the self-configuring monitor interface 50. Each type of display system also has a hinged connector 60 that allows the viewing angle of the display screen 70 to be adjusted.

Figure 2:
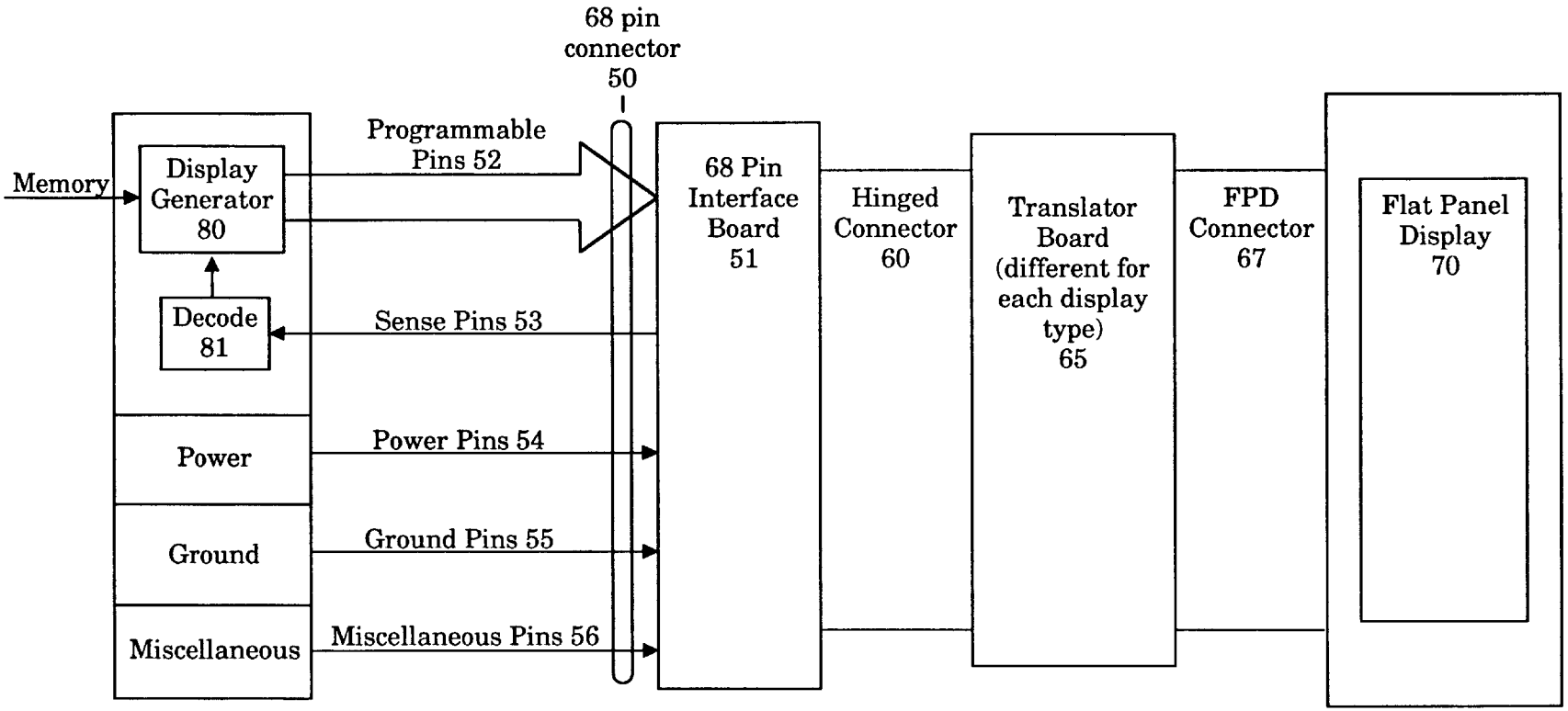
FIG. 2 illustrates a block diagram of a display system assembly and a self-configuring monitor interface.

FIG. 2 illustrates a block diagram of a display system assembly and a self-configuring monitor interface 50. The display system assembly consists of a 68 pin interface board 51 that couples to the self-configuring monitor interface 50. In the display system assembly, the 68 pin interface board 51 directs the signals through a hinged connector 60. After the hinged connector 60, the signals are routed through a translator board 65 that is different for each type of display system. The translator board 65 routes and outputs the signals onto a flat panel display connector 67 as required by the display system's manufacturer specifications. The signals pass through the flat panel display connector 67 and drive the flat panel display 70.

The self-configuring monitor interface 50 consists of a 68 pin connector interface. The 68 pin connector interface comprises a set of sense signals 53, a set of programmable signals 52, power signals 54, ground signals 55, and miscellaneous signals 56.

The set of sense signals 53 consists of code generated by the display system. Each different type of display system generates a unique code that is output on the sense signals 53. The unique code output by the sense signals 53 for each type of display system is generated by circuitry on the translator board 65 or the interface board 51. On the 68 pin self-configuring monitor interface 50 as disclosed in FIGS. 3*a* and 3*b*, signals 44, 10, and 43 are sense signals SD1, SD2, and SD3 respectively.

The function of the programmable signals 52 is determined by what unique code is output by display system on the sense signals 53. Referring to FIG. 2, the interface board 61 of the display system assembly outputs a unique code on the sense signals 53. The sense signals 53 are decoded by a decoder 81 in the computer system. The decoded information from the sense signals 53 is passed to a display generator 80. Using the display system's unique code, the display generator 80 generates the proper video information on the programmable signals 52 to drive the display as dictated by the specifications provided by the display system's manufacturer.

For example, if the display system is a monochrome display system, the programmable signals will carry pixel intensity information and sync information. When a color display system is connected to the self-configuring monitor interface 50, the display generator 80 will generate the proper red, green, and blue intensity information along with the sync information.

The power signals 54 and ground signals 55 supply the display systems with power to drive the display and the backlighting. The power and ground signals are always in the same place on the self-configuring monitor interface 50 and always perform the same function.

Finally, a set of miscellaneous signals 56 provide additional functionality for the self-configuring monitor interface 50. In the present embodiment, the miscellaneous signals 56 carry transmit (Tx) and Receive (Rx) signals such that a serial data interface can be implemented through the self-configuring monitor interface 50.

FIGS. 3*a* and 3*b* define the signals in the 68 pin self-configuring monitor interface 50 of the preferred embodiment for three different flat panel display systems. As can be seen in FIGS. 3*a* and 3*b,* the locations of the power signals and the ground signals always remains the same. However, the display information output on the programmable signals varies depending upon the type of display system connected to the 68 pin self-configuring monitor interface 50.

Although the present invention has been described in terms of specific exemplary embodiments, it will be appreciated that various modifications and alterations might be made by those skilled in the art without departing from the spirit and scope of the invention as set forth in the following claims.

What is claimed is:

1. An apparatus for coupling a flat panel display system to a computer system, said flat panel display having a plurality of inputs, said apparatus comprising the elements of:

a display controller on said computer system, said display controller comprising the elements of at least one fixed power connector for providing electrical power to said flat panel display system;

at least one fixed ground connector for providing electrical ground to said flat panel display system;

multiple multi-purpose connectors for carrying display information to display on said flat panel display system, said multi-purpose connectors carrying at least three red values, at least three green values, and at least three blue values;

at least one fixed sense connector for carrying an identifier code, said identifier code for identifying a type of said flat panel display system among a plurality of flat panel display system types; and a circuit for driving said display information on said multipurpose connector to display on said flat panel display system;

a hinged connector for coupling with said connectors on said display controller;

a translator board for coupling to said hinged connector, said translator board comprising the elements of a routed circuit board, said routed circuit board for properly routing said electrical power, said electrical ground, and said display information including said red, said blue, and said green values to said plurality of inputs on said flat panel display system;

an identifier code generator, said identifier code generator generating said identifier code identifying said type of said flat panel display among a plurality of flat panel display types.

2. The apparatus as claimed in claim 1 further comprising:

at least one miscellaneous connector, said miscellaneous connector for carrying serial communications data.

3. The apparatus as claimed in claim 1 wherein said display information is encoded in response to said identifier code on said at least one fixed sense connector.

4. The apparatus as claimed in claim 1 further comprising the elements of:

a memory unit, said memory unit for storing image information; and a display driver, said display driver coupled to said memory unit, said display driver for reading said image information and for generating said display information on said multiple multi-purpose connectors.

5. A method of implementing a computer interface to drive a flat panel display system, said flat panel display having a plurality of inputs, said method comprising the steps of:

driving at least one fixed power connector on said computer interface, said fixed power connector for providing electrical power to said flat panel display system;

driving at least one fixed ground connector on said computer interface, said fixed ground connector for providing electrical ground to said flat panel display system;

reading at least one sense connector on said computer interface, said sense connector for carrying an identifier that identifies a type of said flat panel display system among a plurality of flat panel display system types said identifier code driven by a translator board in said flat panel display system;

driving multiple multi-purpose connectors with image information, including at least three blue values, at least three red values and at least three green values, to generate a display on said type of display system, said image information specifically encoded on said multi-purpose connector in a format for driving said display flat panel system;

coupling said power, ground, sense, and multipurpose connectors to a said flat panel display system with a hinged connector;

routing said electrical power, said electrical ground, and said image information, including said blue, said red, and said green values, with said translator board in said flat panel display system to properly drive said flat panel display system.

6. The method as claimed in claim 5 further comprising the step of:

driving at least one miscellaneous connector, said miscellaneous connector for carrying serial communications data.

* * * * *